US005096372A

United States Patent [19]

Maejima

[11] Patent Number: 5,096,372

[45] Date of Patent: Mar. 17, 1992

[54] PAPER FEEDING/PILING APPARATUS FOR SHEET-FED PRESS

[75] Inventor: Kazuhiro Maejima, Chiba, Japan

[73] Assignee: Komori Corporation, Tokyo, Japan

[21] Appl. No.: 522,562

[22] Filed: May 14, 1990

[30] Foreign Application Priority Data

May 17, 1989 [JP] Japan ..... 1-121444

[51] Int. Cl.[5] ..... B65G 59/02

[52] U.S. Cl. ..... 414/796.7; 414/795.8; 271/158

[58] Field of Search ..... 271/157, 158, 159; 414/795.8, 796.7, 796.8, 790.8

[56] References Cited

U.S. PATENT DOCUMENTS

| | | | |
|---|---|---|---|
| 2,900,186 | 8/1959 | Schwebel | 271/158 |
| 3,888,364 | 6/1975 | Inoue et al. | 414/796.8 X |
| 3,951,401 | 4/1976 | Marass | 271/158 |
| 3,975,011 | 8/1976 | Marass | 271/157 |
| 3,998,448 | 12/1976 | Gray et al. | 414/795.8 X |
| 4,174,831 | 11/1979 | Marass et al. | 271/171 X |
| 4,418,907 | 12/1983 | Shultz et al. | 414/795.8 X |
| 4,703,924 | 11/1987 | Marass | 271/158 X |
| 4,799,847 | 1/1989 | Bodewein | 414/790.8 |
| 4,971,311 | 11/1990 | Tsukimoto | 271/157 X |

*Primary Examiner*—Robert J. Spar

*Assistant Examiner*—Craig Slavin

*Attorney, Agent, or Firm*—Blakely, Sokoloff, Taylor & Zafman

[57] ABSTRACT

A paper feeding/piling apparatus for a sheet-fed press includes a fork reciprocating unit, a fork unit lifting unit, and a piling/conveying unit. The fork reciprocating unit includes a fork support table supported between a pair of vertically movable right and left guide rails horizontally extending between the pile table and the auxiliary pile unit and reciprocated back and forth, and a plurality of forks supported by the fork support table and fitted in or removed from grooves of the pile board at an upper position upon reciprocal movement of the fork support table. The fork reciprocating unit has forward and backward limit positions detected by detectors. The fork unit lifting unit includes a guide rail drive unit, supported on apparatus frames, for vertically driving the guide rails, and detectors for regulating upper and lower limit positions of the guide rails. The piling-/conveying unit includes a truck for mounting the pile board on which the next sheets are piled, and a truck drive unit for reciprocally driving the truck between the auxiliary pile position and the pile table. The piling-/conveying unit has forward and backward limit positions regulated by detectors.

8 Claims, 9 Drawing Sheets

PAPER FEEDING/PILING APPARATUS FOR SHEET-FED PRESS

BACKGROUND OF THE INVENTION

The present invention relates to a paper feeding/piling apparatus for feeding next sheets piled in advance without stopping the press when sheets piled on a pile table run out in a feeder for a sheet-fed press.

Sheets piled on a pile board on the pile table are sucked one by one by a sucker from the uppermost sheet, and the sucked sheet is supplied to a printing unit. In this case, the pile table is automatically moved upward in accordance with a decrease in the number of sheets, and the upper end face of the pile of sheets is maintained constant. When the sheets on the pile board run out, the press is stopped, and the pile board is moved to the lower limit. The empty pile board is replaced with a pipe board full of sheets piled in advance. The pile board is moved upward to a predetermined position, and upward movement of the pile board is then switched to automatic upward movement, thereby restarting paper feeding.

In a conventional paper feeding/piling apparatus, as described above, the press is stopped and reloading of sheets is performed. For this reason, productivity is degraded, and waste of paper is increased at the time of restart of paper feeding. A paper feeding/piling apparatus capable of reloading paper without stopping the press has been proposed.

In a conventional paper feeding/piling apparatus of this type, skills are required, and operability is not always satisfactory. In addition, reloading must be performed within a short period of time, and a large number of sheets are wasted within this period of time if the operator is not skilled. In addition to halt of the press, manual operations are required, and satisfactory energy saving cannot be expected.

SUMMARY OF THE INVENTION

It is an object of the present invention to provide a paper feeding/piling apparatus for a sheet-fed press, which can improve operability, energy saving and productivity, and eliminate a requirement for skills of reloading.

In order to achieve the above object of the present invention, there is provided a paper feeding/piling apparatus for a sheet-fed press, including a pile table which is mounted with a pile board having sheets piled thereon and is automatically moved upward in accordance with a decrease in number of sheets, and an auxiliary pile unit for piling next sheets on a next pile board during paper feeding, comprising a fork reciprocating unit including a fork support table supported between a pair of vertically movable right and left guide rails horizontally extending between the pile table and the auxiliary pile unit and reciprocated back and forth, and a plurality of forks supported by the fork support table and fitted in or removed from grooves of the pile board at an upper position upon reciprocal movement of the fork support table, the fork reciprocating unit having forward and backward limit positions detected by detecting means, a fork unit lifting unit including a guide rail drive unit, supported on apparatus frames, for vertically driving the guide rails, and detecting means for regulating upper and lower limit positions of the guide rails, and a piling/conveying unit including a truck for mounting the pile board on which the next sheets are piled, and a truck drive unit for reciprocally driving the truck between the auxiliary pile position and the pile table, the piling/conveying unit having forward and backward limit positions regulated by another detecting means.

According to the present invention, sheets piled on a pile table through a pile board are sucked by a sucker and fed to a printing unit. Upon feeding of the sheets, the pile table is automatically moved upward. During printing, the next sheets are piled on a pile board of an auxiliary pile unit. When the number of sheets is reduced during feeding, and the pile table is moved upward to a predetermined position, a fork support table moved downward together with guide rails by a fork lifting unit is moved forward, so that forks are inserted into grooves. The sheets reduced in number are fed while being received by the forks, and at the same time the released pile table is moved downward, thus removing the empty pile board. A truck on which the pile board piled with sheets at an auxiliary pile position is loaded is driven by a drive unit and moved below the pile table. When these sheets on the pile board are fed onto the pile table, the pile table is moved upward and the upper end face of the pile of sheets comes close to the sheets supported by the forks. Upward movement of the pile table is temporarily stopped. After the positions of the upper and lower piles of sheets are adjusted, the pile table is slightly moved upward, and the upper and lower piles come close to each other. In this state, the forks are removed, and normal paper feeding is started.

DESCRIPTION OF THE PREFERRED EMBODIMENT

FIG. 1 to 15 show a paper feeding/pile apparatus for a sheet-fed press according to an embodiment of the present invention.

Figure 7:
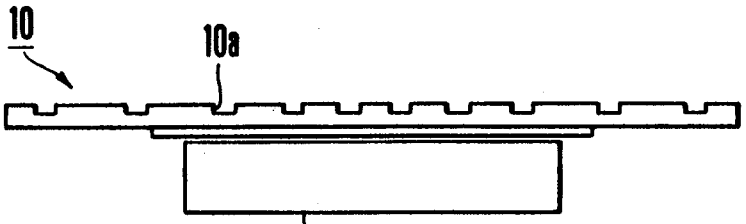
FIG. 7 is a side view of a pile board in the paper feeding/piling apparatus shown in FIG. 1.

Referring to FIGS. 1 to 15, a pair of inverted L-shaped right and left frames 1 extend upward at rear positions of a printing unit (not shown) on the floor foundation. A rear end portion of a horizontal member of each frame 1 is supported by a column 2 on the floor surface. A driving shaft 3 and a driven shaft 4 are pivotally supported between the right and left frames 1. Four sprockets 5 and two sprockets 6 are respectively mounted on the driving and driven shafts 3 and 4. A rectangular pile table 9 is suspended by lifting chains 7 and 8 respectively looped around the sprockets 5 and 6. A pile board 10 is placed on the pile table 9. The pile board 10 has a square shape, and a plurality of grooves 10*a* extending in the back-and-forth direction are formed on the upper surface of the pile board 10, as shown in FIG. 7. Sheets 11 are placed on the pile board 10. The driving shaft 3 is connected to a drive unit (not shown) and driven in the normal and reverse directions. Upon driving of the driving shaft 3 in the normal and reverse directions, the pile table 9 is vertically moved through the lifting chains 7 and 8. The sheets 11 are sucked one by one from the uppermost sheet by a sucker (not shown) and are fed to a printing unit. When the number of sheets 11 is reduced during feeding, the pile table 9 is automatically moved upward by an action of a sensor for detecting a paper level. The lifting drive unit can be manually operated, and the pile table 9 can be vertically moved by an operation with a push button.

Two rails 12 extend from a position below the pile table 9 on the floor surface along the rear direction. An auxiliary pile unit 13 is arranged above the rear end portion of the rails 12. The auxiliary pile unit 13 comprises a truck 14 driven on the rails 12 by a truck convey unit (to be described later). A pile board 10A identical with the pile board 10 is placed on the truck 14. Next sheets 11A are piled on the pile board 10A during printing. Reference numeral 15 denotes a lock handle for fixing the truck 14 on the rails 12. A pair of right and left brackets 18 are slidably fitted on a guide shaft 17 for connecting upper end portions of right and left columns 16 extending on the floor surface. A front jogger 19, the front end of which abuts against the sheets 11A to align them, is suspended from each bracket 18. The front jogger 19 is slidably engaged with a guide 20. The front jogger 19 is moved in the right-and-left direction in accordance with paper sizes. A pair of right and left side joggers 22 are respectively supported on pairs of upper and lower brackets 21 fixed to the right and left support columns 16 to be movable in the right-and-left direction. The pair of right and left joggers 22 align the side ends of the sheets 11A and can be adjusted in accordance with sheet sizes.

Figure 11:
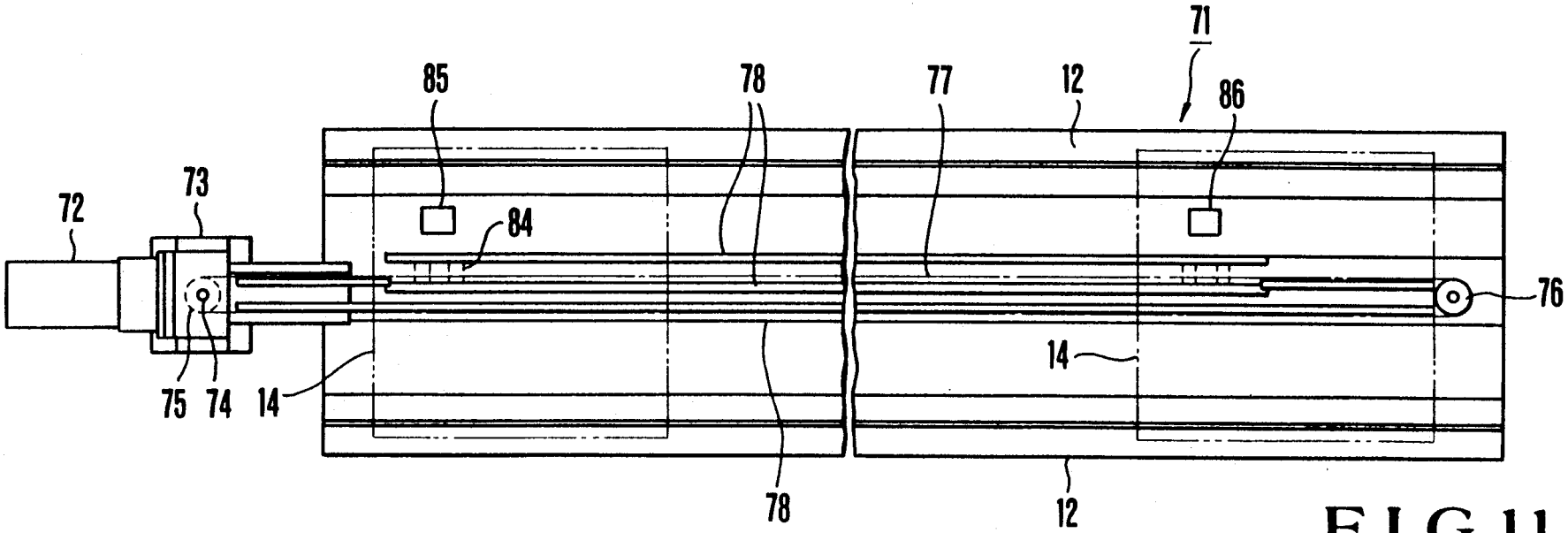
FIG. 11 is a truck convey unit in the paper feeding-/piling apparatus shown in FIG. 1.
Figure 9:
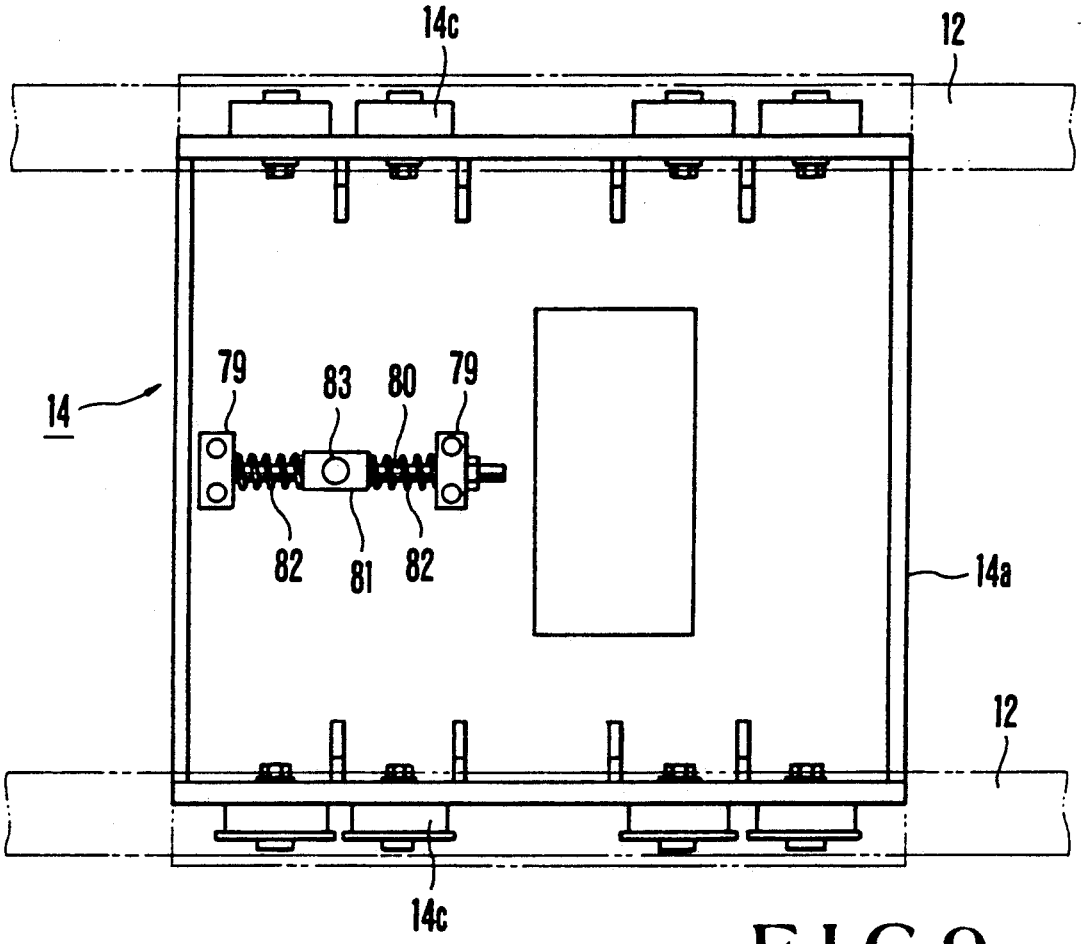
FIG. 9 is a plan view of a truck unit in the paper feeding/piling apparatus shown in FIG. 1.
Figure 10:
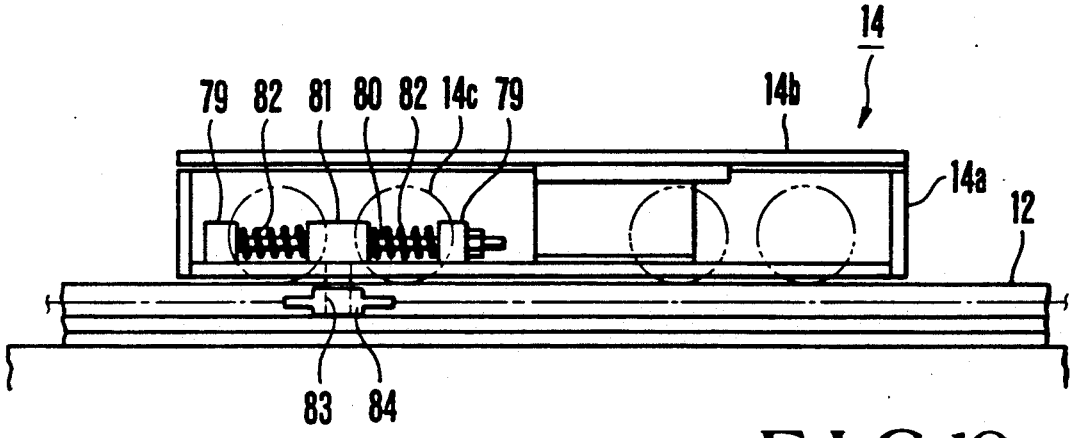
FIG. 10 is a side view of the truck unit.

A piling/conveying unit 71 for conveying the sheets IIA piled on the truck 14 in the auxiliary pile unit 13 to a paper feed position below the pile table 9 will be described with reference to FIG. 9 to 11. The truck 14 in the piling/conveying unit 71 comprises a flat box-like frame 14*a*, a lid 14*b* for closing an upper opening of the frame 14*a*, and four wheels 14*c* which are supported by the frame 14*a* and in rolling contact with each rail 12. Collars of the wheels 14*c* of the truck 14 are engaged with stepped portions of the rails 12 to regulate movement of the truck 14 in the direction of sheet width. A motor 72 is fixed on a motor base 73 placed on the floor surface behind the start ends of the rails 12. A sprocket 75 is axially mounted on a vertical shaft 74 coupled to a motor shaft of the motor 72 through a bevel gear (not shown). A sprocket 76 is pivotally mounted on end portions of the rail 12. An endless chain 77 is looped between the sprockets 76 and 75 along three guides 78 extending parallel to the rails 12. A shaft 80 is supported between a pair of bearings 79 fixed on the bottom plate of the frame 14*a*. A connecting member support metal member 81 is slidably fitted on the shaft 80 through damper springs 82 inserted between bearings 79 and the support metal member 81. A connecting member 84 fixed to the chain 77 is axially mounted on the connecting member shaft 83 supported by the support metal member 81 and extending through the bottom plate of the frame 14*a*. When the chain 77 is driven together with the connecting member 84 through the sprockets 75 and 76 upon rotation of the motor 72, the truck 14 runs along the rails 12 to convey the sheets 11A. Reference numerals 85 and 86 denote limit switches for detecting both moving ends of the truck 14 to stop the motor 72 and stop the truck 14 at the auxiliary piling position and the paper feeding position. The damper springs 82 damp the impact imposed when the truck 14 is stopped.

Forks for temporarily receiving a small number of sheets, a fork reciprocating unit, and a fork lifting unit are arranged between the auxiliary pile unit 13 and the pile table 9. That is, a pair of right and left lifting guides 24 are fixed at the rear end of the horizontal member of the frame 1. A guide groove 24*a* is formed in each lifting guide 24, and a guide groove 16*a* corresponding to the guide groove 24*a* is formed in the column 16. Reference numerals 25 denote a pair of right and left guide rails made of elongated rods extending in the back-and-forth direction. Racks 26 each having an almost square section are respectively fixed on the inner sides of the guide rails by bolts. A roller 27 pivotally supported at one end of each guide rail 25 and a guide portion 25*a* at the other end thereof are respectively fitted in the guide grooves 24*a* and 16*a*, so that the guide rails 25 can be vertically moved between a lower operation position indicated by a solid line in FIG. 1 and an upper retracted position indicated by a dotted line in FIG. 1. A motor 28 having a horizontal motor shaft is fixed to a motor base 28*a* fixed to the upper end portion of one lifting guide 24. A chain 32 is looped between a sprocket 29 mounted on a motor shaft of the motor 28 and a sprocket 31 mounted on a sprocket shaft 30 pivotally supported between the right and left lifting guides 24. A chain 34, a counterweight of which is suspended from its one end, is looped on a sprocket 33 mounted on the sprocket shaft 30. A chain 39, a counterweight of which is suspended from its one end, is looped between a sprocket 35 on the sprocket shaft 30 and a sprocket 38 loosely fitted on a round stay 37 which connects the rear end portions of the right and left horizontal stays 36. The lower ends of the chains 34 and 39 are fixed to the ends of front and rear portions of the right and left racks 26, respectively. When the motor 28 is rotated in the normal and reverse directions, the racks 26 are vertically moved together with the guide rails. Limit switches 34*a* and 34*b* which are turned on by strikers arranged on the chain 34 are arranged near the sprocket 33. When the limit switches 34*a* and 34*b* are turned on, the motor 28 is stopped to regulate the upper and lower end limits of the guide rails 25. Reference numeral 40 denotes a fork support base constituted by side plates 41, a stay 42 having a rectangular section, connected to the side plates 41, and extending in the right-and-left direction, and a pipe stay 43 extending in the right-and-left direction. Rollers 44 pivotally mounted on the side plates 41 are supported by the racks 26, respectively. The rollers 44 are in rolling contact with the racks 26 and the guide rails 25 formed integrally with the racks 26 and are moved back and forth. A motor 45 is mounted on the fork support base 40, and a pinion shaft 46 is pivotally supported between the right and left side plates 41. A chain 49 is looped between a sprocket 47 axially mounted on a motor shaft of the motor 45 and a sprocket 48 mounted on the pinion shaft 46. Pinions 50 axially mounted on the pinion shaft 46 are meshed with the racks 26. Upon rotation of the motor shaft of the motor 45, the pinions 50 are rotated through the chain 49 and roll on the racks 26, thereby moving the fork support base 40 back and forth. A plurality of rod-like forks 51 horizontally extending in the back-and-forth direction extend on the pipe stay 43 of the fork support base 40 at the same pitch as that of the grooves 10*a* of the pipe board 10. The distal end portion of each fork 51 is slidably supported by a holder 53 (FIG. 8) fixed to a stay 52 having a rectangular cross section. With the above structure, when the fork support base 40 is moved forward to move the forks 51 in the forward direction while the guide rails 25 are kept in the lower position, the forks 51 are respectively inserted into the grooves 10*a* of the pile board 10 located at the upper position, thereby supporting sheets 11B reduced in number.

Figure 1:
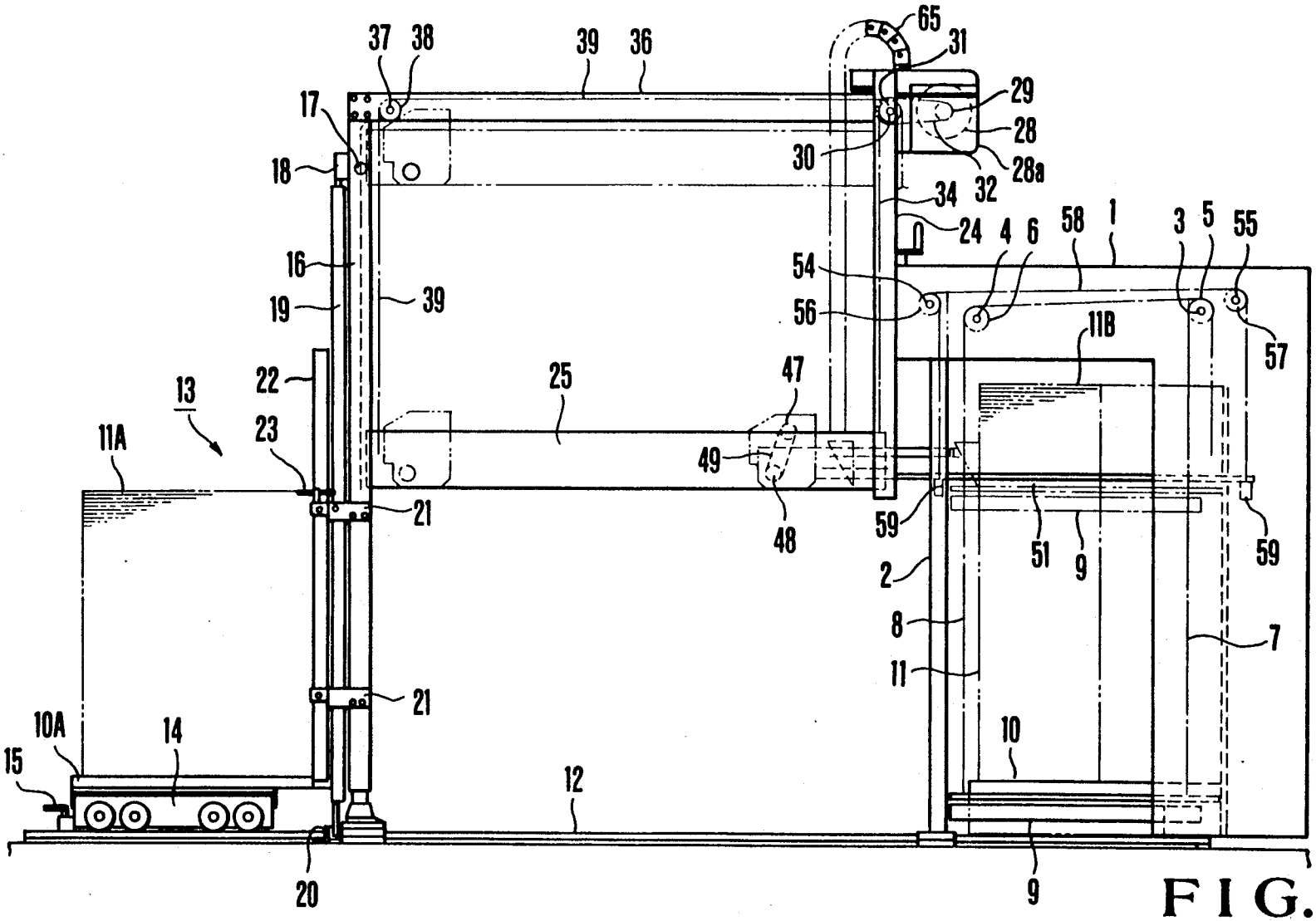
FIG. 1 is a schematic side view showing a paper feeding/piling apparatus according to an embodiment of the present invention.
Figure 2:
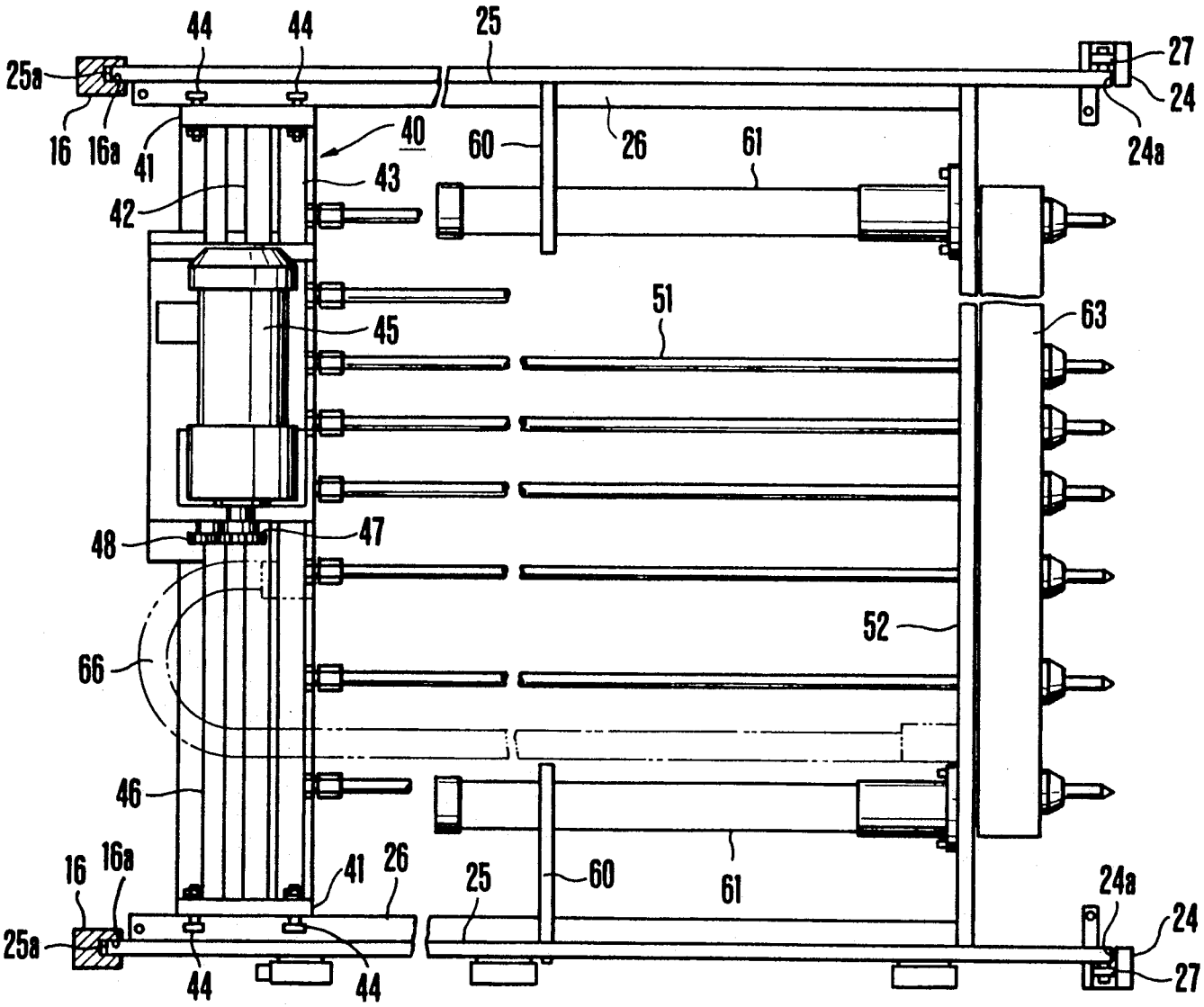
FIG. 2 is a plan view of a fork reciprocating unit in the paper feeding/piling apparatus shown in FIG. 1.
Figure 3:
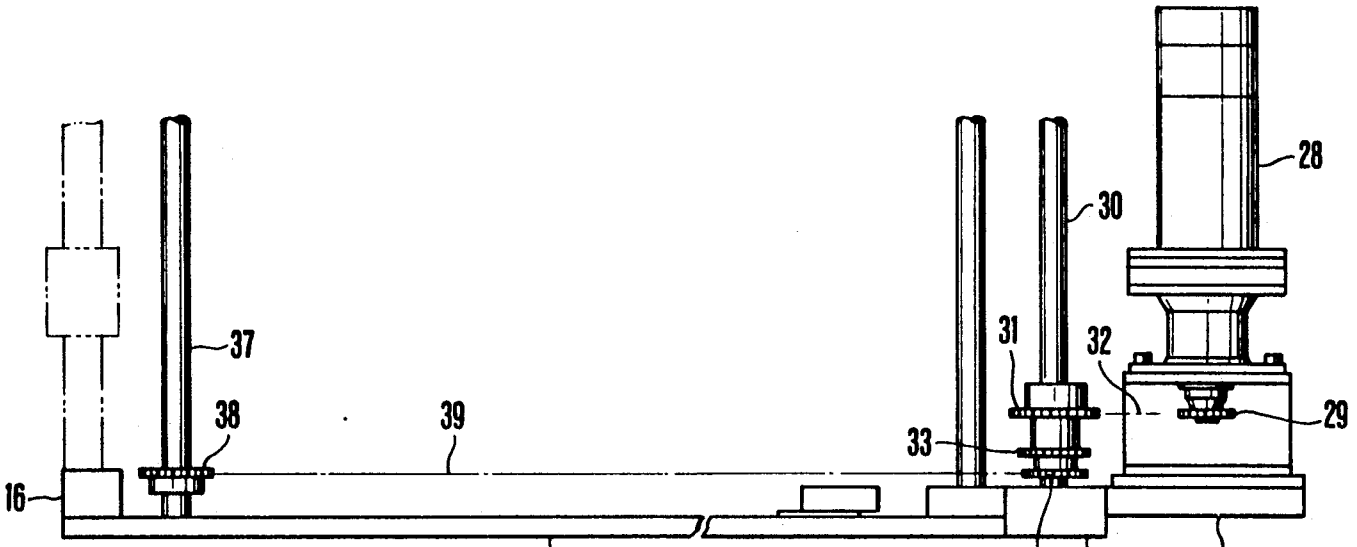
FIG. 3 is a plan view of a fork lifting drive unit in the paper feeding/piling apparatus shown in FIG. 1.
Figure 4:
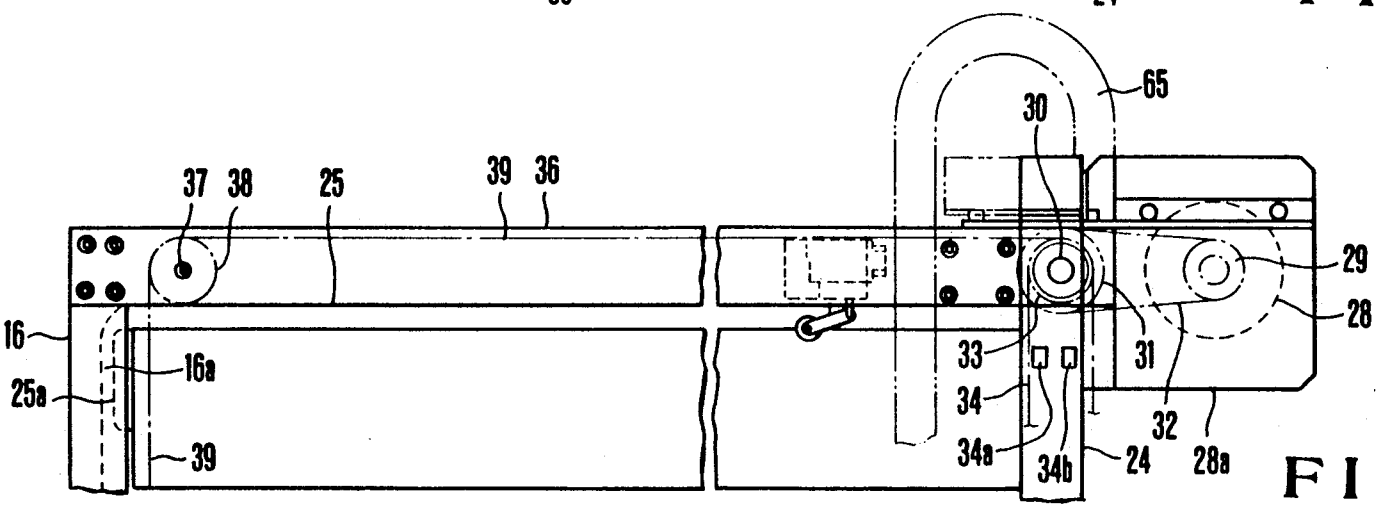
FIG. 4 is a side view of the fork lifting drive unit.
Figure 5:
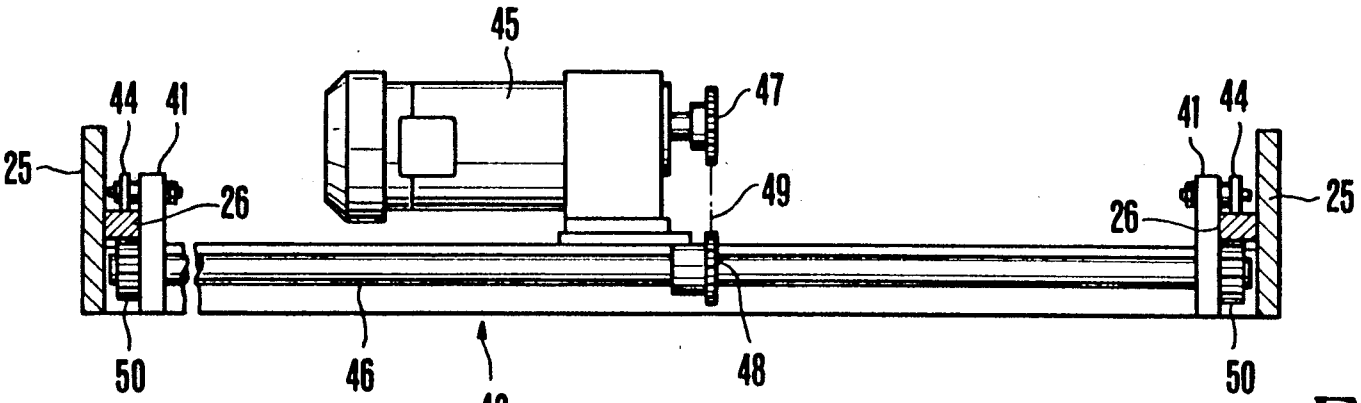
FIG. 5 is a front view of the fork reciprocating unit.
Figure 6:
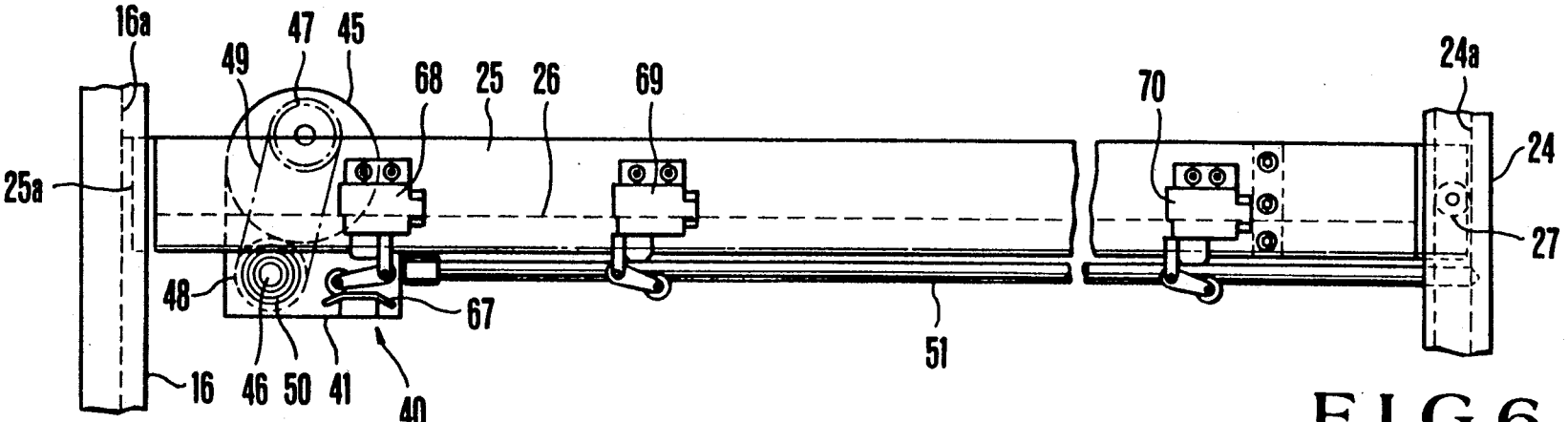
FIG. 6 is a side view of the fork reciprocating unit.

A driving shaft 54 and a driven shaft 55 are pivotally supported between the right and left frames 1, as shown in FIG. 1. Four sprockets 56 and two sprockets 57 are mounted on the shafts 54 and 55, respectively. A fork receiver 59 is suspended from a lifting chain 58 looped between the sprockets 56 and 57. The driving shaft 54 is driven by a drive unit (not shown), and the fork receiver 59 is vertically moved between positions indicated by the solid and dotted lines in FIG. 13. The forks 51 inserted into the grooves 10*a* are supported by the fork receiver 59 at the upper limit position. Reference numeral 60 denotes a guide fixed to the frames 1 to guide vertical movement of the fork receiver 59. Reference numerals 60*a* and 60*b* denote limit switches for detecting the upper and lower limits (in a sheet empty state) of the fork receiver 59 to stop its vertical movement.

Figure 8:
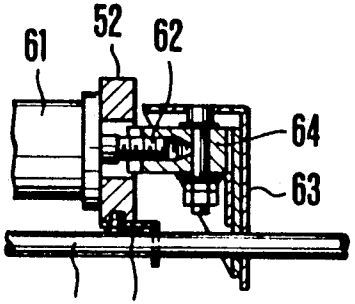
FIG. 8 is a sectional view of a sheet holder in the paper feeding/piling apparatus shown in FIG. 1.

A pair of right and left air cylinders 61 are fixed to the stay 52 and extend in the back-and-forth direction. A paper holder 63 having a triangular section and extending in the right-and-left direction, as shown in FIG. 8, is fixed to an actuation end of a piston rod 62 of each air cylinder 61 through a fastening metal member 64. The forks 51 slidably extend through the holes of the paper holder 63. With this arrangement, when the forks 51 are removed from the grooves 10*a*, the paper holder 63 is moved forward upon operation of the air cylinder 61 to push the rear edges of the sheets 11B, and the sheets 11B are not misaligned.

In the apparatus of this embodiment, since the motor 45 is moved in the vertical and back-and-forth directions, an electrical wiring cable for the motor 45 is supported by flexible chains 65 and 66. Limit switches 68, 69, and 70 are fixed on one guide rail 25 to turn on the limit switches 68, 69 and 70 upon contact with a striker 67 formed on the fork support base 40, thereby regulating movement of the forks 51 at three positions.

Figure 12:
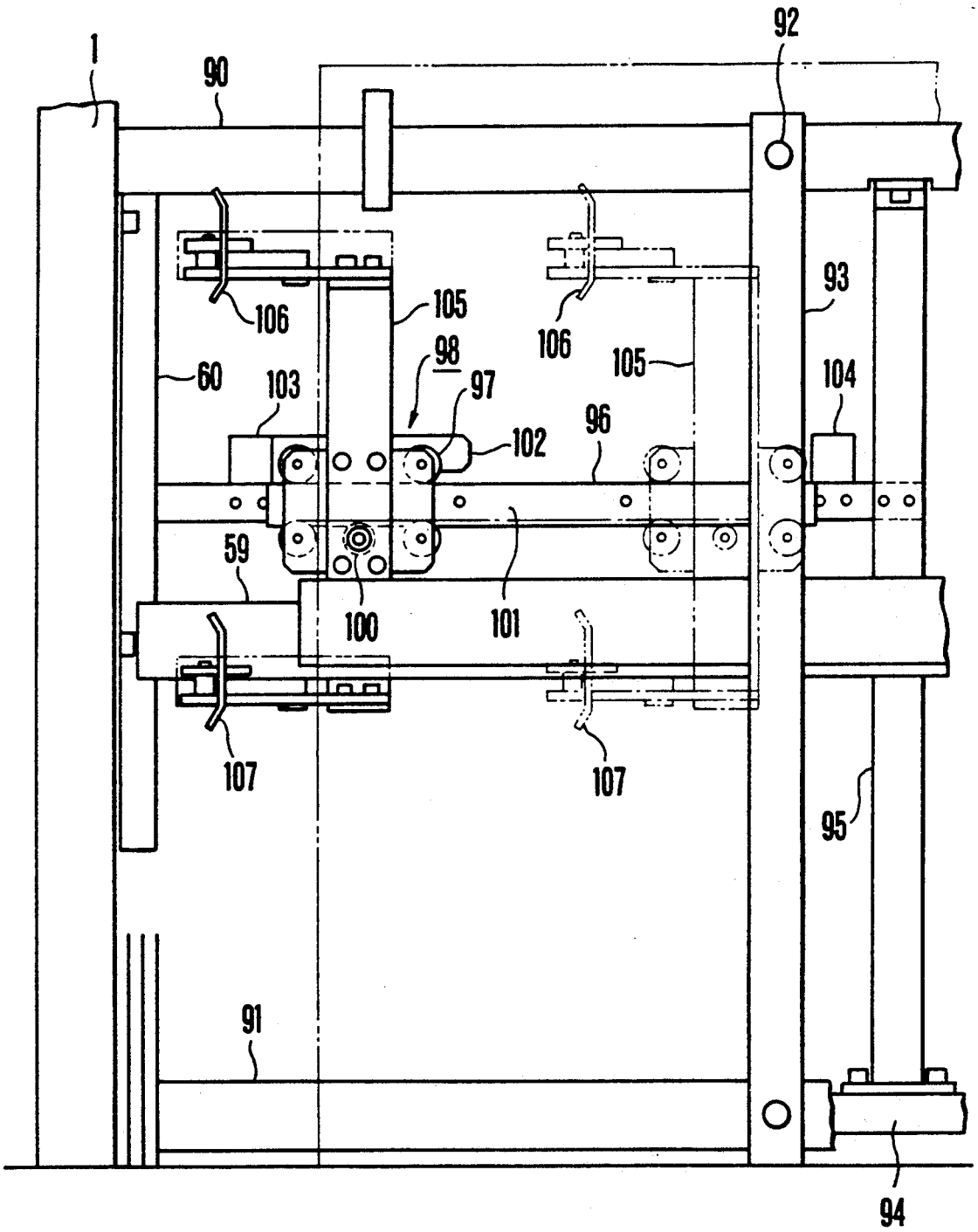
FIG. 12 is a side view showing a sheet positioning unit in the paper feeding/piling apparatus shown in FIG. 1.
Figure 13:
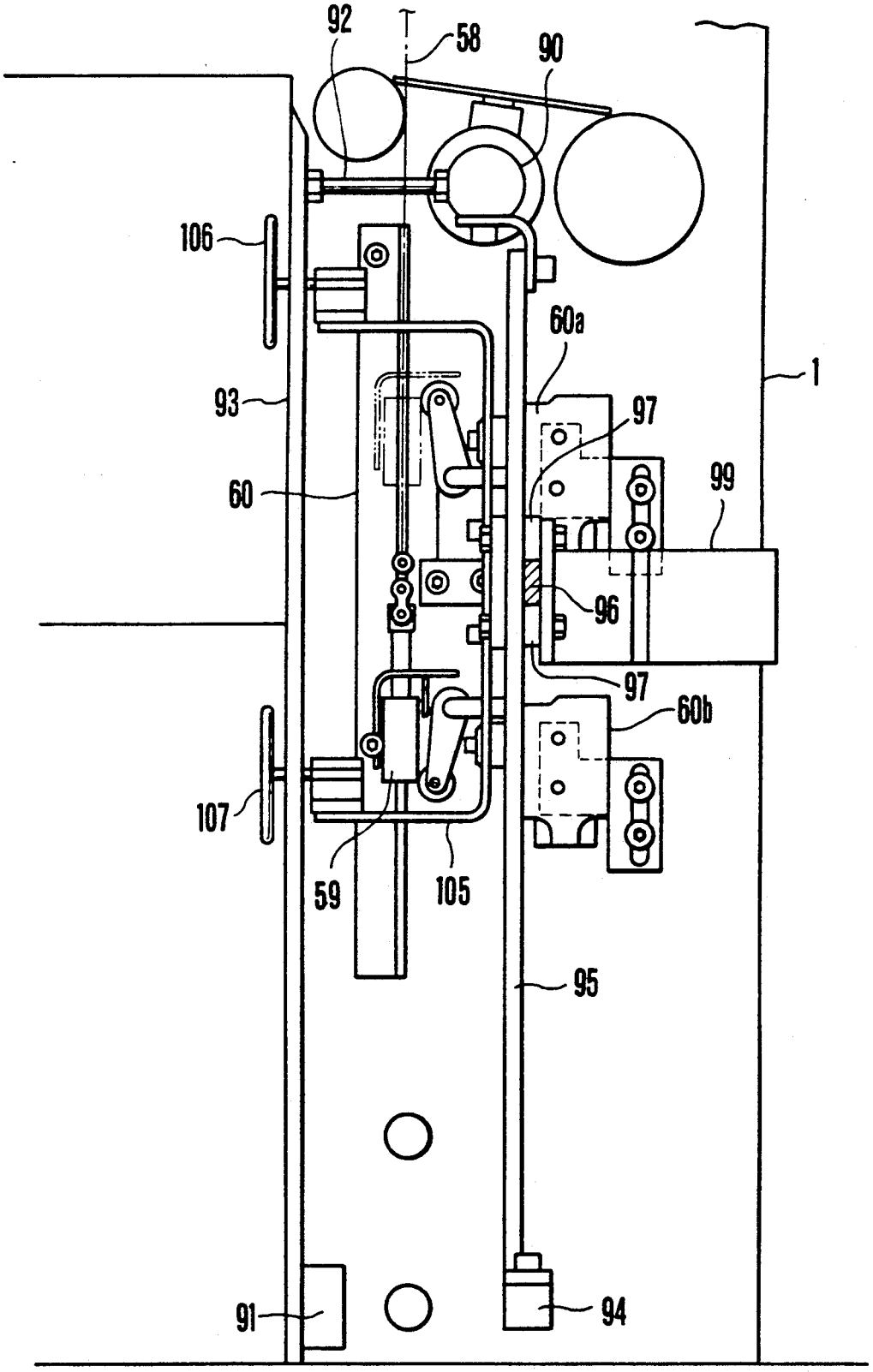
FIG. 13 is a front view of the sheet positioning unit.

A sheet positioning unit is arranged in the feeding-/piling apparatus of this embodiment to align the sheets piled on the forks 51 with the next sheets to be moved upward. More specifically, as shown in FIGS. 12 and 13, the upper and lower end portions of the right and left frames 1 are connected by round and rectangular stays 90 and 91 near the sheets 11B. A plurality of abutment members 93, the upper ends of which are fixed to the round stay 90, are directly bolted at their lower ends to the rectangular stay 91. The abutment members 93 comprise elongated vertical bars which are brought into contact with the ends of the sheets 11B to align them. The lower end portions of the right and left frames 1 near a position immediately below the round stay 90 are connected by another rectangular stay 94. The rectangular stay 94 is connected to the round stay 90 through a vertical bar 95. The vertical bar 95 is connected to one frame 1 through a horizontal bar 96. A moving plate 98 having four rollers 97, i.e., upper, lower, right, and left rollers, which are in rolling contact with its upper, lower, right, and left surfaces is supported on the horizontal bar 96 to be movable in the horizontal direction. The four rollers 97 are mounted to hold the horizontal bar 96 from its both sides. A motor 99 is mounted on the moving plate 98. A pinion 100 is mounted on the moving plate 98 and is pivotally connected to the motor 99 through an intermediate gear (not shown). The pinion 100 is meshed with a rack 101 fixed to the horizontal bar 96. Upon rotation of the pinion 100 driven by the motor 99, the moving plate 98 meshed with the rack 101 is moved between positions indicated by solid and dotted lines in FIG. 12. The moving plate 98 corresponds to a paper size and is moved for sheet positioning (to be described later). Reference numeral 102 denotes a striker fixed to the moving plate 98. Reference numerals 103 and 104 denote limit switches for stopping the motor 99 upon abutment of the striker 102 to the limit switches 103 and 104 to regulate the moving limits of the moving plate 98. A bracket 105 having a U-shaped side view and extending in the vertical direction is fixed on the moving plate 98. An upper end detection switch 106 and a lower end detection switch 107 are mounted on the upper and lower end portions of the bracket 105, respectively. When the pile table 9 is mounted with the pile board 10 filled with sheets and transferred from the truck 14 and is located at the lower position, the pile table 9 is driven by a motor (not shown) and movable in the right-and-left direction of FIG. 12. When the sheets 11 moved together with the pile table 9 abut against the lower detection switch 107, the motor is stopped to interrupt movement of the pile table 9. The sheets 11B temporarily supported by the forks 51 abut against the upper detection switch 106, and the upper detection switch 106 is stopped through the motor 99 and the moving plate 98. With the above arrangement, the upper detection switch 106 is moved until it abuts against the sheets 11B, and the lower sheets 11 are moved upward until they abut against the lower detection switch 107 which is in-phase with the upper detection switch 106. Therefore, the upper and lower sheets 11B and 11 are aligned with each other.

Figure 14:
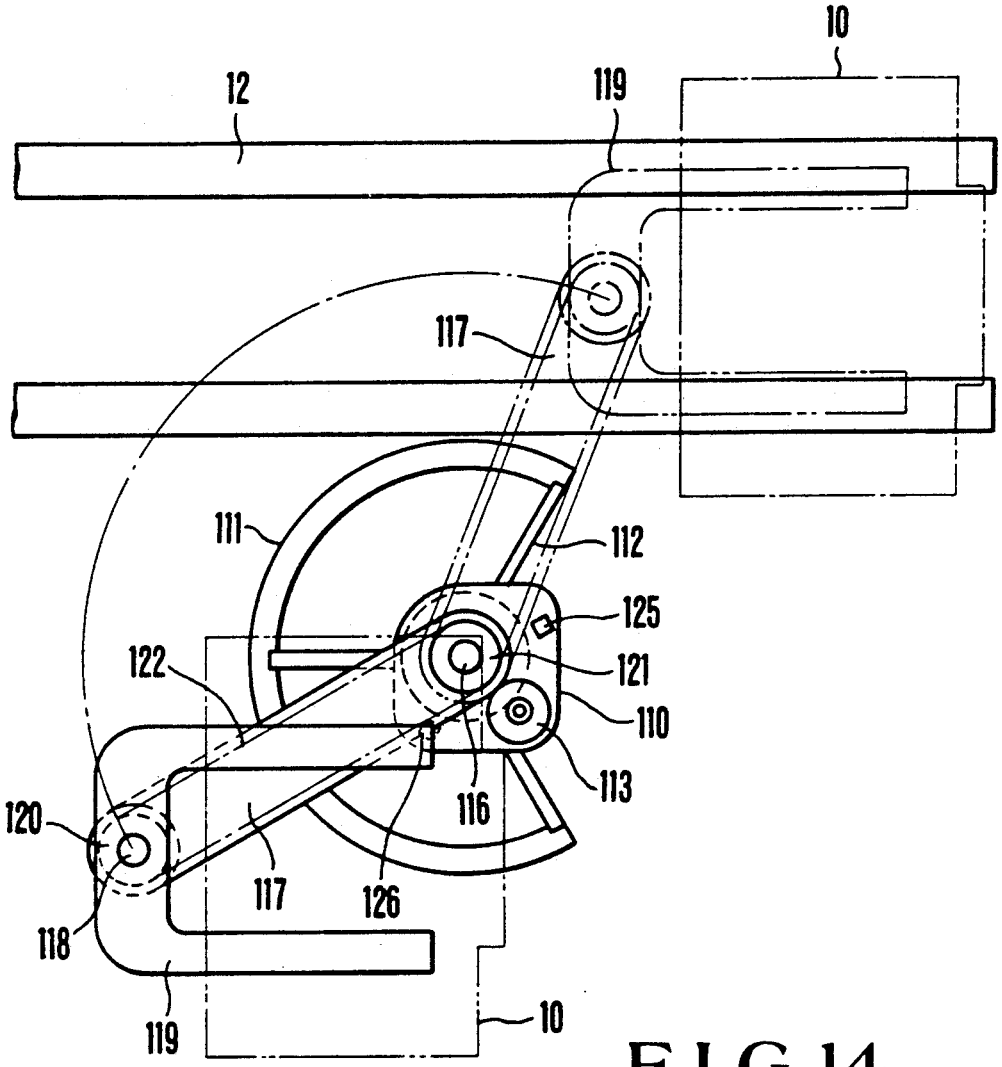
FIG. 14 is a plan view of a pile board removing unit in the paper feeding/piling apparatus shown in FIG. 1.
Figure 15:
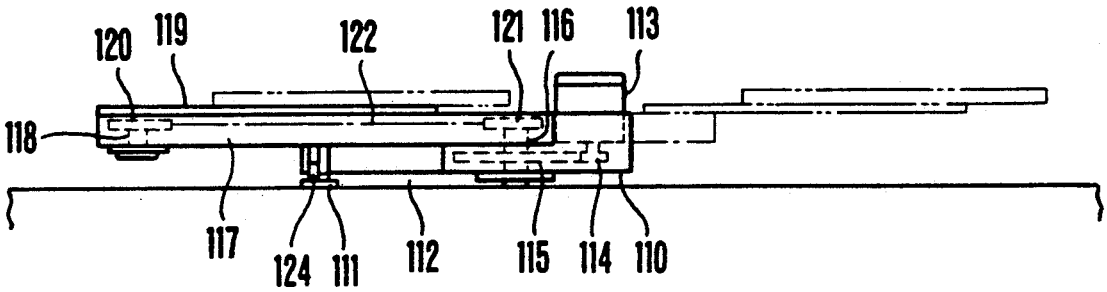
FIG. 15 is a side view of the pile board removing unit.

A pile board removing unit for removing a descended empty pile board 10 is arranged in the paper feeding-/piling apparatus of this embodiment. As shown in FIGS. 14 and 15, a motor base 110 and an arcuated guide 111 are connected through a plurality of arms 112 at a position obliquely downward from the paper feeding position and are fixed on the floor surface. A motor 113 is mounted on the motor base 110. A shaft 116 connected to the motor 113 through gears 114 and 115 is pivotally supported at the central portion of the motor base 110. A fork shaft 118 is pivotally supported by a free end portion of an arm 117 fixed to the shaft 116. Reference numeral 119 denotes a U-shaped fork fixed on the fork shaft 118. A chain 122 is looped between a sprocket 120 on the fork shaft 118 and a sprocket 121 on the shaft 116. Upon rotation of the motor 113, the sprocket 120 is rotated about its axis and is rotated together with the arm 117 about the shaft 116. Reference numeral 124 denotes a roller which is in rolling contact with the guide 111 to allow smooth pivotal movement upon pivotal movement of the arm 117. Reference numeral 10 denotes a pile board; and 12, rails. Limit switches 125 and 126 are mounted on the motor base 110 to detect pivotal limits of the arm 117 to stop the motor 113. With the above arrangement, when the motor 113 is rotated in the normal or forward direction while the fork 119 and the like are located at the position of the solid line, the arm 117 is pivoted to the position of the dotted line upon meshing between the gears 114 and 115 to cause the fork 119 to receive the empty pile board 10. The motor 113 is then rotated in the reverse direction to pivot the arm 117, thereby removing the pile board 10 outside the paper feeding/piling apparatus. In this case, the fork 119 is not rotated about its axis by the behavior of the chain 122 and is always directed in the same direction.

An operation of the paper feeding/piling apparatus having the above arrangement will be described below. The sheets 11 piled on the pile table 9 through the pile board 10 are fed one by one from the uppermost sheet by a sucker to a printing unit. The driving shaft 3 is rotated by a drive unit operated in response to a paper level detection sensor during paper feeding, and the pile table 9 is moved upward through the lifting chains 7 and 8. Thus, the upper surface of the pile of the sheets 11 is maintained at a predetermined height. While printing is performed during paper feeding described above, the sheets 11A are piled on the pile board 10A placed on the truck 14 of the auxiliary pile unit by the front jogger 19 and the side joggers 22. In a normal operation, the guide rails 25 are stored in the upper portion. However, when upward movement of the pile table 9 is detected by a detector (not shown) fixed on the frame 1 at a position immediately below the position where the forks 51 are inserted, the guide rails 25 are moved upward to the lower operation position.

When the pile table 9 is moved upward during paper feeding and then to the position indicated by the dotted line in FIG. 1, the motor 45 is operated by the corresponding the limit switch, and the pinion shaft 46 is rotated through the chain 49, thereby rotating the pinions 50 since they are meshed with the racks 26. The fork support base 40 is moved forward while the pinions 50 are in rolling contact with the racks 26. At the same time, the forks 51 are moved below the sheets 11B whose amount is decreased. That is, the forks 51 are respectively inserted into the grooves **10*a* of the pile board 10. The forward limit of the forks 51 is regulated by the limit switch 70. The driving shaft 54 is rotated by a drive unit upon insertion of the forks 51 into the grooves 10*a*. The fork receiver 59 located at the lower position is moved upward to the position indicated in FIG. 1. When the fork receiver 59 lightly touches the forks 51, the limit switch 60*a* detects this contact, thereby stopping the fork receiver 59. The sheets 11B are supported by the forks 51 and are separated from the pile table 9. When the driving shaft 3 is rotated, the pile table 9 is mounted with the empty pile board 10 and is moved upward to the lower limit position indicated by the solid line in FIG. 1**.

The fork 119 of the pile board removing unit supports the descending empty pile board 10 at the position indicated by the dotted line in FIG. 14. The motor 113 is rotated to pivot the arm 117 to the position indicated by the solid line, and the pile board 10 is removed from the paper feeding/piling apparatus. Upon removal of the pile board 10, the front and side joggers 19 and 22 of the auxiliary pile unit are opened, and the motor 72 of the piling/conveying unit 71 is started. The chain 77 is driven, and the truck 14 whose connecting member 84 is fixed to the chain 77 is driven along the rails 12. The truck 14 is stopped at the paper feeding position upon detection of the limit switch 85, and the pile board 10A on which the sheets 11A are piled is transferred from the truck 14 to the pile table 9. The motor 72 is then rotated in the reverse direction, and the truck 14 is returned to the auxiliary pile position. Upon detection of the limit switch 86, the truck 14 is stopped. The pile table 9 is formed by a pair of bars and the truck 14 can be loaded or unloaded at the lower limit position. However, a detailed description thereof will be omitted.

During feeding of the sheets 11A, as shown in FIG. 12, the upper and lower detection switches 106 and 107 are moved to the left so as to be separated from the sheets 11A and 11B, respectively. The pile table 10 on which the lower sheets 11A are loaded is moved to the right in a direction away from the detection switches 106 and 107 upon driving of the motor. In this state, when the pile table 9 loaded with the sheets 11A is moved upward to a height enough to cause the detection switch 107 to detect the sheets 11A upon rotation of the driving shaft 3, the motor 99 is rotated to move the moving plate 98, and the upper detection switch 106 comes close the the upper sheets 11B. When the upper detection switch 106 is brought into contact with the lowermost sheet 11B, the motor 99 is stopped, and the switches 106 and 107 are turned off. At the same time, the pile table 9 loaded with the lower sheets 11A is moved by the motor and stopped at the position where the lower detection switch 107 detects the uppermost sheet 11A. The upper and lower sheets 11B and 11A are aligned with each other. When alignment is completed, the driving shaft 3 is slightly pivoted to move the pile table 9 upward. The pile table 9 is stopped at a position where the upper and lower sheets 11B and 11A contact each other. As a result, a load detector (not shown) arranged in the fork receiver 59 detects the contact, and the piston rods 62 of the air cylinders 61 are moved forward. The paper holder 63 fixed to the piston rods 62 is moved forward to hold the contact edges of the upper and lower sheets 11B and 11A. In this state, the motor 45 is rotated in the reverse direction, and the fork support base 40 is moved backward. The forks 51 are also moved backward and are removed from a space between the upper and lower sheets 11B and 11A. Since the forks 51 are removed from the sheets 11B, the weight of the sheets 11B is loaded on the forks 51, and the sheets 11B and 11A tend to be moved toward the removal direction of the forks 51. However, since the sheets are held by the paper holder 63, they are not actually moved in the removal direction. After the forks 51 are removed, the piston rods 62 of the air cylinders 61 are moved backward, and the paper holder 63 is then retracted. Upon removal of the forks 51, the upper and lower sheets 11B and 11A are stacked as a single stack, thereby continuing normal paper feeding.

During maintenance and inspection of the feeding apparatus, the guide rails 25 are moved upward together with the forks 51 and the fork support base 40 to the position of the dotted line in FIG. 1, and the guide rails 25 are stored in the upper portion. Therefore, maintenance personnel can perform maintenance or inspection operations below the guide rails 25.

As is apparent from the above description according to the present invention, a paper feeding/piling apparatus for a sheet-fed press, including a pile table which is mounted with a pile board having sheets piled thereon and is automatically moved upward in accordance with a decrease in number of sheets, and an auxiliary pile unit for piling next sheets on a next pile board during paper feeding, comprises a fork reciprocating unit including a fork support table supported between a pair of vertically movable right and left guide rails horizontally extending between the pile table and the auxiliary pile unit and reciprocated back and forth, and a plurality of forks supported by the fork support table and fitted in or removed from grooves of the pile board at an upper position upon reciprocal movement of the fork support table, the fork reciprocating unit having forward and backward limit positions detected by detecting means, a fork unit lifting unit including a guide rail drive unit, supported on apparatus frames, for vertically driving the guide rails, and detecting means for regulating upper and lower limit positions of the guide rails, and a piling/conveying unit including a truck for mounting the pile board on which the next sheets are piled, and a truck drive unit for reciprocally driving the truck between the auxiliary pile position and the pile table, the piling/conveying unit having forward and backward limit positions regulated by another detecting means. A series of operations for replacing the empty pile board with a pile board on which next sheets are piled can be fully automated without stopping the press and without requiring manual operations. Therefore, operability of the apparatus can be improved, and waste of sheets upon halt of the apparatus can be eliminated. In addition, energy saving can be achieved, productivity can be improved, and skills are not required.

What is claimed is:

1. A paper feeding/piling apparatus for a sheet-fed press, including a pile table which is mounted with a pile board having sheets piled thereon and is automatically moved upward in accordance with a decrease in number of sheets, and an auxiliary pile unit for piling next sheets on a next pile board during paper feeding, comprising:

a fork reciprocating unit including a fork support table supported between a pair of vertically movable right and left guide rails horizontally extending between said pile table and said auxiliary pile unit and reciprocated back and forth, and a plurality of forks supported by said fork support table and fitted in or removed from corresponding grooves on the upper surface of said pile board at an upper position upon reciprocal movement of said fork support table, said fork reciprocating unit having forward and backward limit positions detected by detecting means, and wherein said plurality of forks support said piled sheets and lift said piled sheets during paper feeding;

a fork lifting unit including a guide rail drive unit, supported on apparatus frames, for vertically driving said guide rails, and detecting means for regulating upper and lower limit positions of said guide rails; and a piling/conveying unit including a truck for mounting said pile board on which the next sheets are piled, and a truck drive unit for reciprocally driving said truck in a lateral direction only, independent of said fork unit lifting unit, between the auxiliary pile position and said pile table, said piling/conveying unit having forward and backward limit positions regulated by another detecting means.

2. An apparatus according to claim 1, wherein said fork support table comprises side plates having rollers, a rectangular stay, and a pipe stay, said rectangular stay and said pipe stay being connected to said side plates, said forks have the same pitch as that of said grooves of said pile board.

3. An apparatus according to claim 2, wherein said fork lifting unit further comprises a driving shaft, a driven shaft, a chain engaged with sprockets mounted on said driving and driven shafts, and a fork receiver, suspended from said chain, for supporting said forks inserted into said grooves of said pile board at an upper position.

4. A paper feeding/piling apparatus for a sheet-fed press, including a pile table which is mounted with a pile board having sheets piled thereon and is automatically moved upward in accordance with a decrease in number of sheets, and an auxiliary pile unit for piling next sheets on a next pile board during paper feeding, comprising:

a fork reciprocating unit including a fork support table supported between a pair of vertically movable right and left guide rails horizontally extending between said pile table and said auxiliary pile unit and reciprocated back and forth, and a plurality of forks supported by said fork support table and fitted in or removed from corresponding grooves on the upper surface of said pile board at an upper position upon reciprocal movement of said fork support table, said fork reciprocating unit having forward and backward limit positions detected by detecting means;

a fork lifting unit including a guide rail drive unit, supported on apparatus frames, for vertically driving said guide rails, and detecting means for regulating upper and lower limit positions of said guide rails, wherein said guide rail drive unit comprises a pair of guides having guide grooves and fixed to frames of said apparatus, columns having guide grooves corresponding to said guide grooves of said guides, guide rails having racks engaged with pinions of said fork support table, each having a roller at one end thereof engaged with a corresponding one of said guide grooves of said guide and a guide portion at the other end engaged with a corresponding one of said guide grooves of said column, a motor mounted on one of said guides, and chains driven by said motor and having lower ends fixed to said racks, thereby moving said racks together with said guide rails; and said detecting means comprises limit switches for driving said motor upon contact with a striker mounted on one of said chains; and a piling/conveying unit including a truck for mounting said pile board on which the next sheets are piled, and a truck drive unit for reciprocally driving said truck between the auxiliary pile position and said pile table, said piling/conveying unit having forward and backward limit positions regulated by another detecting means.

5. An apparatus according to claim 1, wherein said truck drive unit comprises a motor located in front of a start position of truck rails on which said truck travels, driving and driven sprockets, an endless chain looped between said driving and driven sprockets, and truck driving means, mounted on said chain, for driving said truck.

6. A paper feeding/piling apparatus for a sheet-fed press, including a pile table which is mounted with a pile board having sheets piled thereon and is automatically moved upward in accordance with a decrease in number of sheets, and an auxiliary pile unit for piling next sheets on a next pile board during paper feeding, comprising:

a fork reciprocating unit including a fork support table supported between a air of vertically movable right and left guide rails horizontally extending between said pile table and said auxiliary pile unit and reciprocated back and forth, and a plurality of forks supported by said fork support table and fitted in or removed from corresponding grooves on the upper surface of said pile board at an upper position upon reciprocal movement of said fork support table, said fork reciprocating unit having forward and backward limit positions detected by detecting means;

a fork lifting unit including a guide rail drive unit, supported on apparatus frames, for vertically driving said guide rails, and detecting means for regulating upper and lower limit positions and said guide rails;

a piling/conveying unit including as truck for mounting said pile board on which the next sheets are piled, and a truck drive unit for reciprocally driving said truck between the auxiliary pile position and said pile table, said piling/conveying unit having forward and backward limit positions regulated by another detecting means; and wherein said truck drive unit comprises a motor located in front of a start position of truck rails on which said truck travels, driving and driven sprockets, an endless chain looped between said driving and driven sprockets, and truck driving means, mounted on said chain, for driving said truck, wherein said truck driving means comprises a shaft extending along said truck rails, a connecting member support metal member mounted on said shaft, bearing mounted on both end portions of said shaft, a connecting member shaft mounted on said connecting member support metal member between said bearings, and a connecting member mounted on said connecting member support shaft.

7. A paper feeding/piling apparatus for a sheet-fed press, including a pile table which is mounted with a pile board having sheets piled thereon and is automatically moved upward in accordance with a decrease in number of sheets, and an auxiliary pile unit for piling next sheets on a next pile board during paper feeding, comprising:

a fork reciprocating unit including a fork support table supported between a pair of vertically movable right and left guide rails horizontally extending between said pile table and said auxiliary pile unit and reciprocated back and forth, and a plurality of forks supported by said fork support table and fitted in or removed from corresponding grooves on the upper surface of said pile board at an upper position upon reciprocal movement of said fork support table, said fork reciprocating unit having forward and backward limit positions detected by detecting means;

a fork lifting unit including a guide rail drive unit, supported on apparatus frames, for vertically driving said guide rails, and detecting means for regulating upper and lower limit positions of said guide rails;

a piling/conveying unit including a truck for mounting said pile board on which the next sheets are piled, and a truck drive unit for reciprocally driving said truck between the auxiliary pile position and said pile table, said piling/conveying unit having forward and backward limit positions regulated by another detecting means; and a pile board removing unit including a motor and an arm for pivoting the empty pile board, said piling-/conveying unit being started upon completion of an operation of said pile board removing unit.

8. A paper feeding/piling apparatus for a sheet-fed press, including a pile table which is mounted with a pile board having sheets piled thereon and is automatically moved upward in accordance with a decrease in number of sheets, and an auxiliary pile for piling next sheets on a next pile board during paper feeding comprising:

a fork reciprocating unit including a fork support table supported between a pair of vertically movable right and left guide rails horizontally extending between said pile table and said auxiliary pile unit and reciprocated back and forth, and a plurality of forks supported by said fork support table and fitted in or removed from corresponding grooves on the upper surface of said pile board at an upper position upon reciprocal movement of said fork support table, said fork reciprocating unit having forward and backward limit positions detected by detecting means;

a fork limiting unit including a guide rail drive unit, supported on apparatus frames, for vertically driving said guide rails, and detecting means for regulating upper and lower limit positions of said guide rails; and a sheet positioning unit including an upper detection switch, brought into contact with the sheets supported by said forks to stop a moving plate which is moved in accordance with a paper size, and a lower detection switch, brought into contact with the next sheets, for stopping movement of said pile board, said lower detection switch being operated in phase with said upper detection switch.

* * * * *

UNITED STATES PATENT AND TRADEMARK OFFICE

CERTIFICATE OF CORRECTION

PATENT NO. : 5,096,372
DATED : March 17, 1992
INVENTOR(S) : Maejima

It is certified that error appears in the above-indentified patent and that said Letters Patent is hereby corrected as shown below:

Column 11, line 14, replace "a air of" with --a pair of--;
line 28, replace "and said" with --of said--;
line 30, replace "as truck" with --a truck--;
line 46, replace "bearing mounted" with --bearings mounted--;
Column 12, line 31, between "pile" and "for" insert --unit--;
line 32, after "paper feeding" insert --,--;
line 46, replace "fork limiting" with --fork lifting--.

Signed and Sealed this

Twelfth Day of September, 1995

*Attest:*

Bruce Lehman

BRUCE LEHMAN

*Attesting Officer*

*Commissioner of Patents and Trademarks*